United States Patent [19]

Meredith

[11] Patent Number: 5,074,555

[45] **Date of Patent: * Dec. 24, 1991**

[54] TAPERED WALL SHAFT WITH REINFORCED TIP

[75] Inventor: Steven E. Meredith, Kennewick, Wash.

[73] Assignee: Sandvik Special Metals Corp., Kennewick, Wash.

[ * ] Notice: The portion of the term of this patent subsequent to Oct. 9, 2007 has been disclaimed.

[21] Appl. No.: 341,804

[22] Filed: Apr. 24, 1989

[51] Int. Cl.[5] ..... A63B 53/12; B21D 3/00

[52] U.S. Cl. ..... 273/80 B; 273/80 R; 273/72 A; 72/367; 148/11.5 F

[58] Field of Search ..... 72/367, 276, 68, 76, 72/282, 283; 273/80 R, 80 B, 72 A, 80.6, 77 R; 29/DIG. 41, DIG. 11, DIG. 12; 148/11.5 F

[56] References Cited

U.S. PATENT DOCUMENTS

| | | | |
|---|---|---|---|
| 391,994 | 10/1888 | Flotow et al. | 273/80 R |
| 601,966 | 4/1898 | Ivins | 72/276 |
| 1,162,960 | 12/1915 | Whyland | 72/206 |
| 1,573,708 | 2/1926 | Hoerle | 273/80 B |
| 1,696,698 | 12/1928 | Sommer | 72/282 |
| 1,713,812 | 5/1929 | Barnhart | 72/367 |
| 1,778,181 | 10/1930 | Brinkman | 273/80 R |
| 1,904,146 | 4/1933 | Larsen | 72/68 |
| 1,962,804 | 6/1934 | Cassady | 72/276 |
| 1,974,271 | 9/1934 | Hackett | 273/80 B |
| 1,979,430 | 11/1934 | Wright | 72/276 |
| 1,983,074 | 12/1934 | Durell | 72/276 |
| 2,001,643 | 5/1935 | Wilcox | 72/276 |
| 2,066,962 | 1/1937 | Cross | 273/80 B |
| 2,095,563 | 10/1937 | Cowdery | 72/276 |
| 2,100,307 | 11/1937 | McMinn | 273/80 B |
| 2,240,456 | 4/1941 | Darner | 72/276 |
| 2,950,811 | 8/1960 | Kreidler | 72/76 |
| 3,292,414 | 12/1966 | Goeke | 72/367 X |
| 3,479,030 | 11/1969 | Merola | 273/72 A |
| 3,570,297 | 3/1971 | Matthews | 72/276 |
| 3,691,625 | 9/1972 | Swenck | 273/72 A |
| 3,812,702 | 5/1974 | Benteler et al. | 72/283 |
| 3,841,130 | 10/1974 | Scott et al. | 273/72 A |
| 3,854,316 | 12/1974 | Wilson | 72/76 X |
| 3,969,155 | 7/1976 | McKeighen | 148/11.5 F |
| 4,157,654 | 6/1979 | Kahlow et al. | 72/367 |
| 4,169,595 | 10/1979 | Kaugars | 273/80 R |
| 4,298,155 | 11/1981 | Palovcik | 72/367 X |
| 4,512,069 | 4/1985 | Hagemeister | 72/367 X |
| 4,523,445 | 6/1985 | Yoshida | 72/76 X |
| 4,616,500 | 10/1986 | Alexoff | 72/276 X |
| 4,622,841 | 11/1986 | Yoshida | 72/367 |
| 4,625,537 | 12/1986 | Aleck | 72/367 X |
| 4,722,216 | 2/1988 | Fencl | 72/76 X |

FOREIGN PATENT DOCUMENTS

| | | | |
|---|---|---|---|
| 54-20191 | 7/1979 | Japan | 72/367 |
| 61-14035 | 1/1986 | Japan | 72/68 |
| 30050 | 4/1913 | United Kingdom | 273/80 B |
| 470178 | 8/1937 | United Kingdom | 273/80 B |
| 1246539 | 9/1971 | United Kingdom | 273/80 B |

*Primary Examiner*—Edward M. Coven
*Assistant Examiner*—Sebastiano Passaniti
*Attorney, Agent, or Firm*—Burns, Doane, Swecker & Mathis

[57] ABSTRACT

A tapered wall shaft with a reinforced tip includes a rear portion, a front portion and an interconnecting portion. The interconnecting portion has a smoothly decreasing outer diameter and a smoothly increasing wall thickness. The tapered wall shaft with a reinforced tip is formed by a rotary swaging operation, a sink drawing operation and a rotary swaging operation.

12 Claims, 5 Drawing Sheets

2
4
10
12
20
21
22
23
26
29
60
61
62

TAPERED WALL SHAFT WITH REINFORCED TIP

BACKGROUND OF THE INVENTION

This invention relates to a method for making improved tubular metallic shafts for golf clubs and other sporting implements.

As is commonly known, a golf shaft undergoes a significant stress during a golf swing at the portion of the shaft where the club head is attached, that is, at the tip portion. Typically, this tip portion of the shaft is of the narrowest diameter with respect to the remainder of the shaft since most golf shafts have a tapered configuration. Thus, unless this tip portion has a sufficient tip strength, it is especially susceptible to deformation when excessive force is used in hitting a golf ball or, in the alternative, a mis-hit occurs and the club head hits the ground. Tip strength is defined as the weight necessary to cause permanent deformation in the shaft when hung about 20 inches from the tip area.

The most convenient way of eliminating such a problem area on the shaft would be to increase its diameter to a value closer to the diameter of the rest of the shaft. Such a remedy is highly undesirable, however, because the weight distribution and moment of inertia inherent in a narrowing diameter or tapering shaft is necessary for execution of the most effective golf swing. More particularly, a tapered shaft is necessary in order to provide the proper "flex" and "flex point" of the shaft for an effective stroke. Both the "flex" and the "flex point" are determined according to the tapering nature of the shaft. In addition, it is undesirable to increase the diameter of the shaft because the hosel of commonly used club heads will not accommodate a larger diameter shaft.

Consequently, various techniques have been used to both reinforce this segment of the shaft (and increase tip strength) and to maintain a narrowing characteristic on the shaft. The most common technique is perhaps the incorporation of a reinforcing metal insert. Such an insert, however, adds undesired weight to the shaft and also requires a retaining feature such as a retaining pin or a special mechanical joining operation to hold the insert in place. Thus, it is desirable to design a shaft without the excessive weight resulting from the use of an insert and having a wall thickness along the tapered length and the tip portion of the shaft able to provide a desired weight distribution and to withstand the forces exerted on the shaft tip.

Methods for making shafts with varying wall thickness are contemplated in the prior art. For example, U.S. Pat. No. 2,095,563 to Cowdery discloses a method of making a golf shaft wherein the shaft is formed to have an OD of several steps by a plurality of draws while an internal mandrel controls the wall thickness at each step.

U.S. Pat. No. 2,240,456 to Darner and U.S. Pat. No. 4,616,500 to Alexoff show methods for providing varying wall thickness on a shaft with a constant outer diameter.

U.S. Pat. No. 3,292,414 to Goeke shows a method that provides a shaft with a tapered end, the tapered end having internal corrugations for strengthening.

U.S. Pat. No. 3,841,130 to Scott, Jr. et al. shows a baseball bat with a tapered, constant-thickness wall.

The shafts disclosed in these patents, however, do not provide a sufficiently strong shaft tip while also providing an optimal moment of inertia for use, for example, as a golf shaft.

OBJECTS AND SUMMARY OF THE INVENTION

An object of the invention is to provide a method for making a shaft that alleviates the problems enumerated above.

A further object of the invention is to provide a shaft having a reinforced tip portion due to increased wall thickness.

A further object of the invention is to provide a shaft having a tapered wall thickness over at least a tapered shank portion of a shaft.

The objects are achieved according to the invention which involves a method of making a shaft, e.g. a golf shaft, having an initial step of providing a metal shaft having a first outer diameter and a first shaft wall thickness and then rotary swaging the metal shaft to form a shaft front portion, a shaft rear portion and an interconnecting portion that interconnects said front and rear portions. The front portion has a second outer diameter smaller than the first outer diameter and a first front portion wall thickness larger than the first shaft wall thickness.

Then the rear portion of the metal shaft is drawn to a third outer diameter smaller than the first outer diameter and larger than the second outer diameter. Then, a region including the front portion, the interconnecting portion and an adjacent segment of the interconnecting portion is rotary swaged such that the front end portion has a fourth outer diameter smaller than the second outer diameter and a second front portion wall thickness greater than the first front portion wall thickness. Further, the interconnecting portion has a smooth taper that narrows from the third outer diameter to the fourth outer diameter.

The invention also contemplates a shaft, e.g. a golf shaft, for sporting implements that includes a rear portion having a first outer diameter and a substantially constant first wall thickness. The shaft also includes a front portion having a second outer diameter smaller than the first outer diameter and a second wall thickness larger than the first wall thickness and substantially constant over a length of the front portion.

Additionally, an interconnecting portion interconnecting the rear portion with the front portion is provided wherein the interconnecting portion has a smoothly decreasing outer diameter from the rear portion to the front portion to form a taper. The interconnecting portion has a smoothly increasing wall thickness along the taper from the first wall thickness to a maximum interconnecting portion wall thickness. Additionally, the maximum interconnecting portion wall thickness is smaller than the second wall thickness of the front portion.

BRIEF DESCRIPTION OF THE DRAWINGS

The objects and advantages of the invention will become apparent from the following detailed description of a preferred embodiment thereof in connection with the accompanying drawings in which like numerals designate like elements, and in which.

DETAILED DESCRIPTION OF THE PREFERRED EMBODIMENTS

Figure 1:
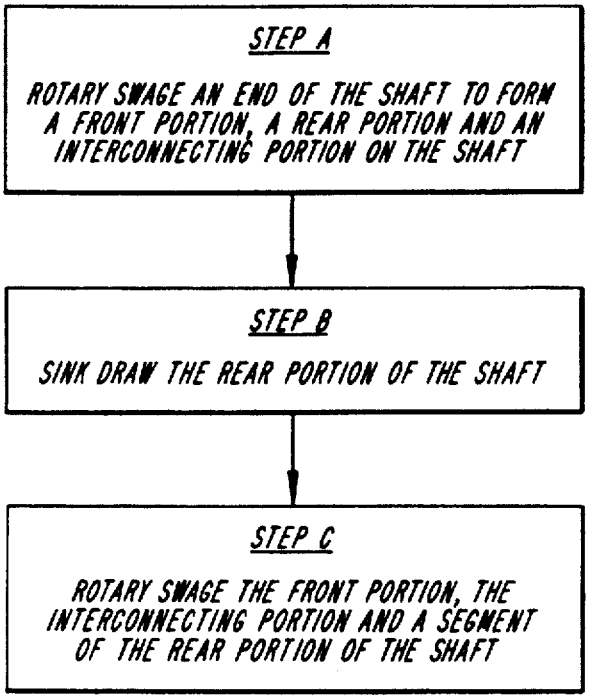
FIG. 1 shows a block diagram including the steps needed to perform a first preferred embodiment of the present invention.

With reference now to the drawings, the various stages of forming a metal shaft are described.

In the golf shaft manufacturing art, the outer diameter of a shaft intended for fabrication into a golf shaft is typically about 0.600". Apparently, the industry has found this diameter to be especially suited to providing any number of desired "flexes" and "flexpoints" in any variety of shafts. This diameter is not particularly suited, however, to providing a tip strength sufficient to render tip reinforcement unnecessary. It is generally estimated that a tip strength of at least 21 lbs. is required to prevent the tip of a golf shaft from excessively bending during play wherein tip strength is defined as the weight necessary to cause permanent deformation in the shaft when hung about 20 inches from the tip area.

In contrast, in the preferred embodiments of the present invention, the outer diameter of a shaft intended for fabrication into a golf shaft is greater than 0.600". By virtue of this greater diameter, enough material is available to fabricate a shaft by conventional drawing and swaging methods that has a tip strength sufficient, i.e., greater than 21 lbs., to render unnecessary any additional reinforcement and that still has the desired "flexes" and "flexpoints".

Referring to FIG. 1 and FIGS. 2A-2C, a first preferred embodiment of the present invention is shown. A shaft 10, made from titanium alloy and intended for use as a golf shaft, is provided having a substantially constant wall thickness 20 and a substantially constant outer diameter 21 over its entire length 2. The outer diameter 21 is preferably about 0.6654", the wall thickness 20 is preferably about 0.020" and length 2 is preferably about 35 inches.

Figures 2A, 2B, 2C:
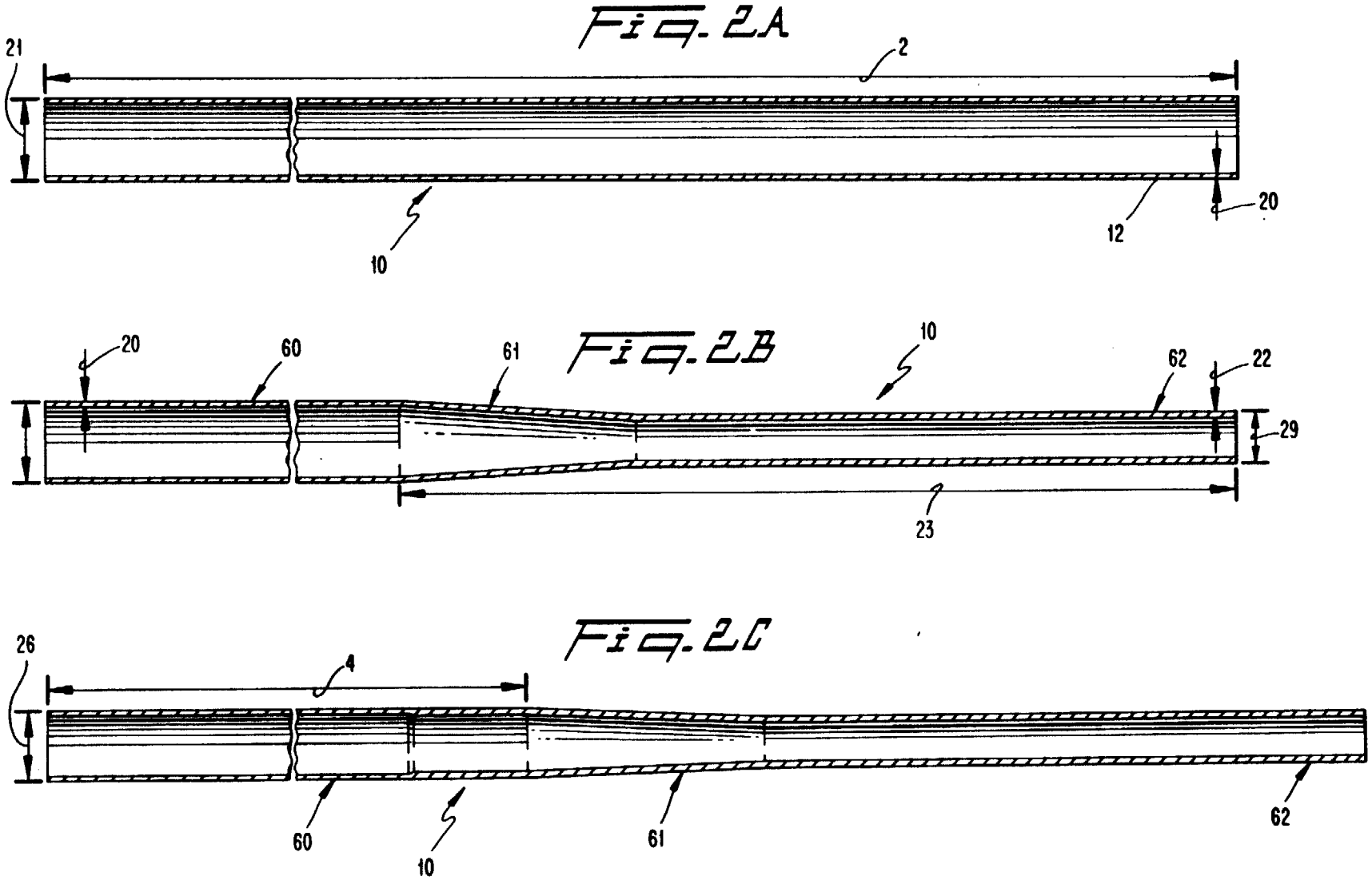
FIGS. 2A–2C show a first preferred embodiment of a shaft during various stages of fabrication.

In the first step A of FIG. 1, one end 12 of shaft 10 is subjected to a conventional rotary swaging operation to form a rear portion 60, a front portion 62 and an interconnecting portion 61 on shaft 10 as shown in FIG. 2B. Interconnecting portion 61 interconnects the rear portion 60 to the front portion 62. Due to the swaging, the outer diameter one end 12 of shaft 10 is decreased to outer diameter 29 and the wall thickness at one end 12 of shaft 10 is increased to a thickness 22. The interconnecting portion 61 and the front portion 62 extend a length 23 at one end 12 of shaft 10. Preferably, the reduced outer diameter 29 is about 0.450", the increased thickness 22 is about 0.030" and length 23 is about 7".

The resulting front portion 62 serves at least two purposes. First, a clamping surface is provided to which a drawing tool can be attached for performing draw passes as discussed below. Second, the shaft now has a portion that is strengthened with respect to the remainder of the shaft due to the increased wall thickness. The increased wall thickness is highly desirable in certain uses for shafts, e.g. use in a golf club.

In step B of the first preferred embodiment of FIG. 1, a drawing tool (not shown) is clamped to the front portion 62 of the shaft in a conventional manner and sink drawing is performed on the rear portion 60 of the metal shaft adjacent the interconnecting portion 61. The sink drawing step includes at least one draw pass and reduces the initial outer diameter 21 of the rear portion 60 of the metal shaft 10 to a smaller outer diameter 26 and increases the length of the rear portion 60 of the metal shaft to an increased length 4 of the shaft as shown in FIG. 2C. Preferably, the smaller outer diameter 26 will be about 0.593" and the increased length 4 will be about 33.75". The smaller outer diameter 26 may be increased to a typically desired outer diameter of about 0.600" in a heat treatment process at the conclusion of all metal working.

Since the outer diameter 21 is reduced through a sink drawing operation, i.e., drawing without an internal mandrel, the wall thickness of the rear portion of the shaft remains substantially the same as it was before drawing. The drawing operation will, however, increase the length of the shaft beyond its initial length due to the cold flow of the metal.

Figure 3:
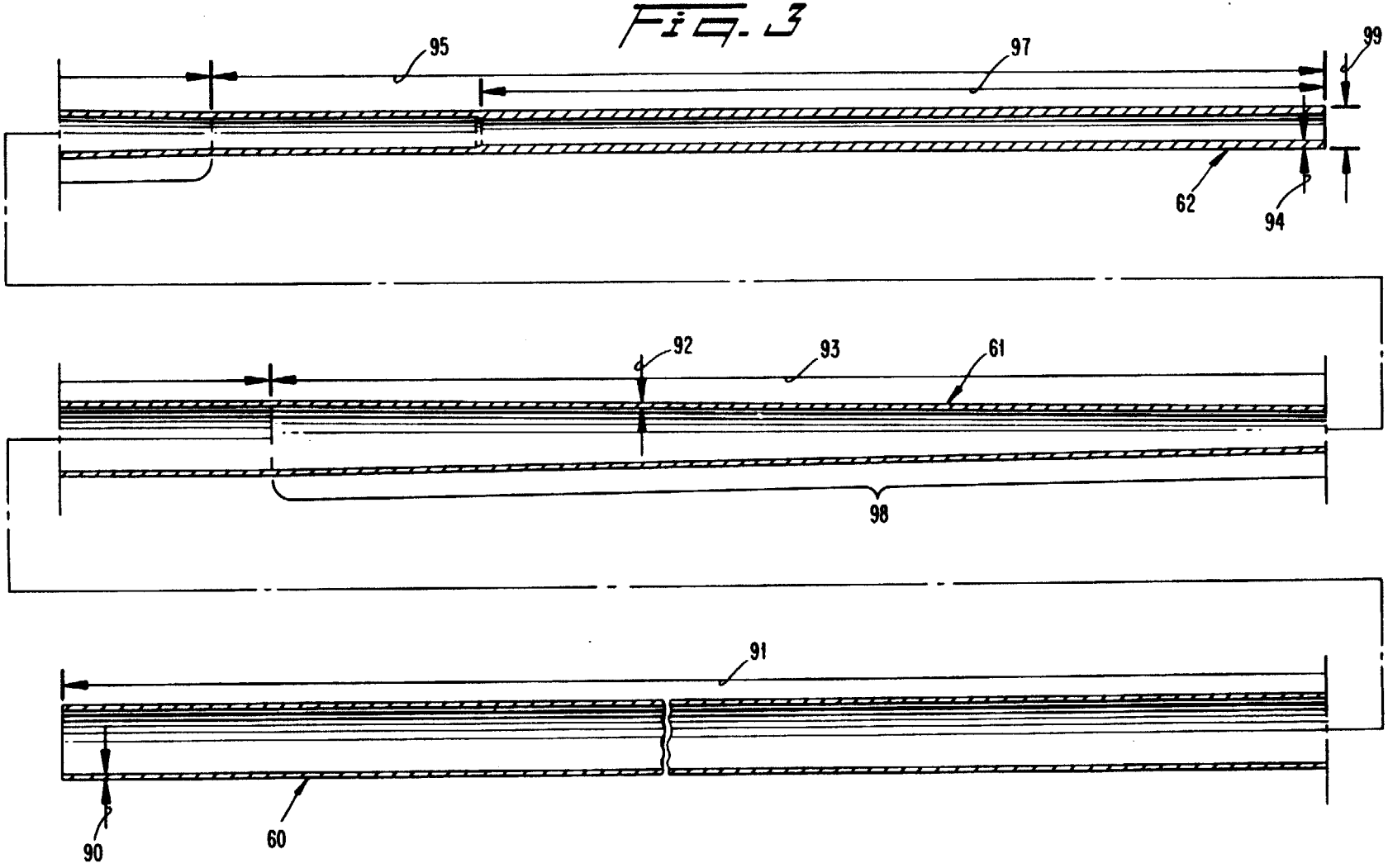
FIG. 3 shows a shaft of the present invention.

In step C of the first preferred embodiment of FIG. 1, the metal shaft 10 is again subjected to a conventional rotary swaging operation, this time performed on a region including the front portion 62, the interconnecting portion 61 and an adjacent segment of the rear portion 60. Referring to FIG. 3, the swaging forms a smooth taper 98 on the interconnecting portion 61 over length 93 and blends the taper 98 with the front portion of the shaft 62. The swaging also reduces the outer diameter 29 on front portion 62 to the final outer diameter 99 while increasing thickness 22 on the front portion 62 to a final thickness 94. The rotary swaging operation may require one to three passes and generally will be performed using long swaging dies as are known in the art. Preferably, the length 93 of the taper 98 of the interconnecting portion 61 is around 10.0" which would require one or two swaging operations using conventional 12"-15" swaging dies. The final outer diameter 99 of the front portion 62 is preferably about 0.370".

After rotary swaging, a segment (not shown) of the front portion 62 of the shaft that has served as a clamping surface for the drawing tool is cut off. The forces exerted on the metal on that segment will have caused scuffing and pitting thus rendering the surface unusable. It, should be noted that only that segment effected by the clamped tool is removed and not the entire tip portion Thus, a front portion 62 of wall thickness 94 remains at the end of the shaft.

The shaft 10 resulting from the method of the present invention has a wall of substantially constant thickness 90 along length 91 of the rear portion 60 of the shaft, a wall of increasing, tapered thickness 92 over the interconnecting portion 61 of the shaft 93, and a wall increasing to a maximum thickness 94 at the front portion 62 of the shaft. Preferably, for a golf club shaft of titanium alloy, the constant thickness 90 of the rear portion is about 0.020" over length 91 of about 20.75", the tapered thickness 92 progresses to about 0.032" over the interconnecting portion of the shaft 61 for a length 93 of about 10" and the maximum thickness increases from about 0.032" to 0.039" over a length 95 of about 9.25" at the front portion 96. For a length 97 of about 7.0" at the front portion 96, the maximum wall thickness 94 is substantially constant at about 0.039". The resulting titanium alloy golf club shaft of the preferred embodiment has an overall length of about 40" and a tip strength of about 23 lbs.

It should be noted that as a final step, the shaft may undergo a heat treatment process wherein one of the results is a growth in the outer diameter of the shaft. In a golf shaft of titanium alloy wherein the outer diameter after drawing is 0.593", the outer diameter after heat treatment will have increased to about 0.600" which is the industry standard for finished golf shafts.

The metal that is particularly suited for this method of making a golf shaft is seamless titanium or titanium alloy (e.g., Ti-3Al-2.5V) tubing although other metal alloys are also acceptable. Welded tubing is not recommended since the weld could crack during swaging.

Figure 4:
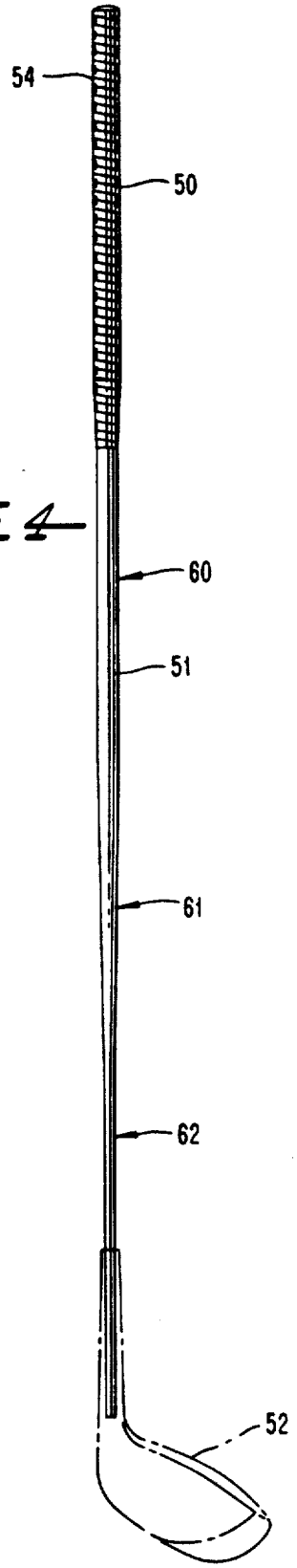
FIG. 4 shows an embodiment of the present invention in use as a shaft for a golf club wood.
Figure 5:
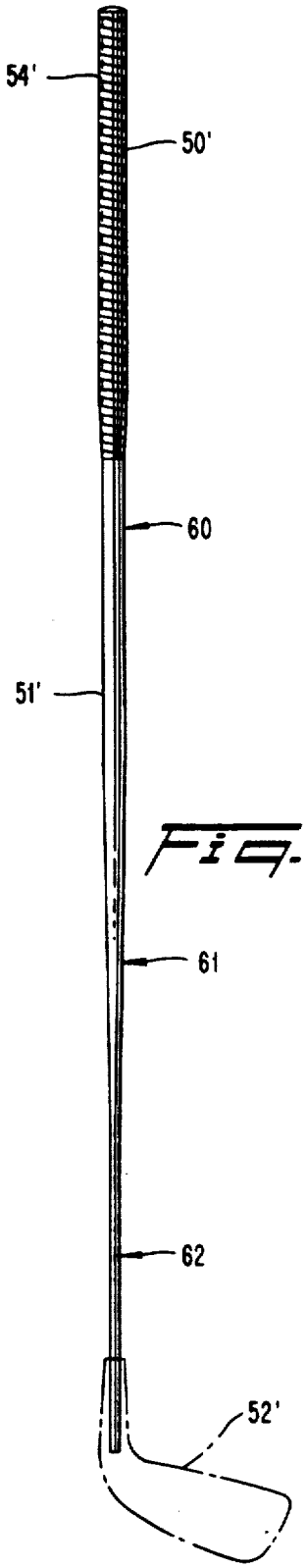
FIG. 5 shows an embodiment of the present invention in use as a shaft for a golf club iron.

This method is particularly adapted for making club irons or club woods as is shown in FIGS. 4 and 5. The golf club includes a handle portion 50 or 50', a shank portion 51 or 51' and a striking portion 50 or 52' (wood or iron, respectively). The handle portion 50 or 50' includes a wrapping 54 or 54' for easier gripping. The handle portion 50 or 50' and shank portion 51 or 51' is formed of the shaft formed as in FIG. 2D with the shank portion 51 or 51' being connected to the appropriate striking portion 52 or 52' by an epoxy resin as is known in the art.

Referring now to FIGS. 6A-6D and FIG. 7, a second preferred embodiment of the present invention will be described.

As with the first embodiment, a shaft made from titanium alloy and intended for use as a golf shaft is provided, however, the outer diameter 21 is preferably 0.625" instead of 0.665" and the wall thickness 20 is preferably about 0.025" instead of 0.020".

Yet, notwithstanding the use of tube stock of a smaller outer diameter 21 than that described in the first embodiment, the outer diameter 21 remains greater than 0.600". Consequently, enough material remains available to form a shaft by conventional drawing and swaging methods having a tip strength sufficient to render unnecessary any additional reinforcement and, further, having the desired "flexes" and "flexpoints".

Figure 7:
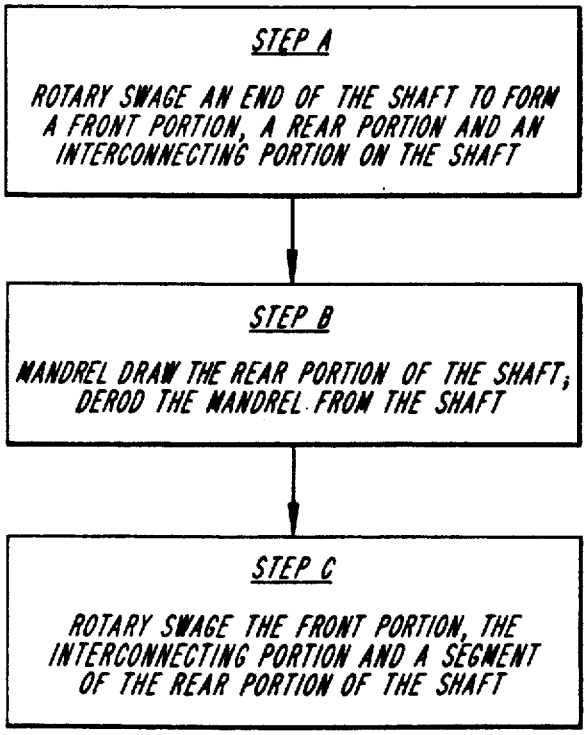
FIG. 7 shows a block diagram including the steps needed to perform a second preferred embodiment of the present invention.
Figures 6A, 6B, 6C, 6D:
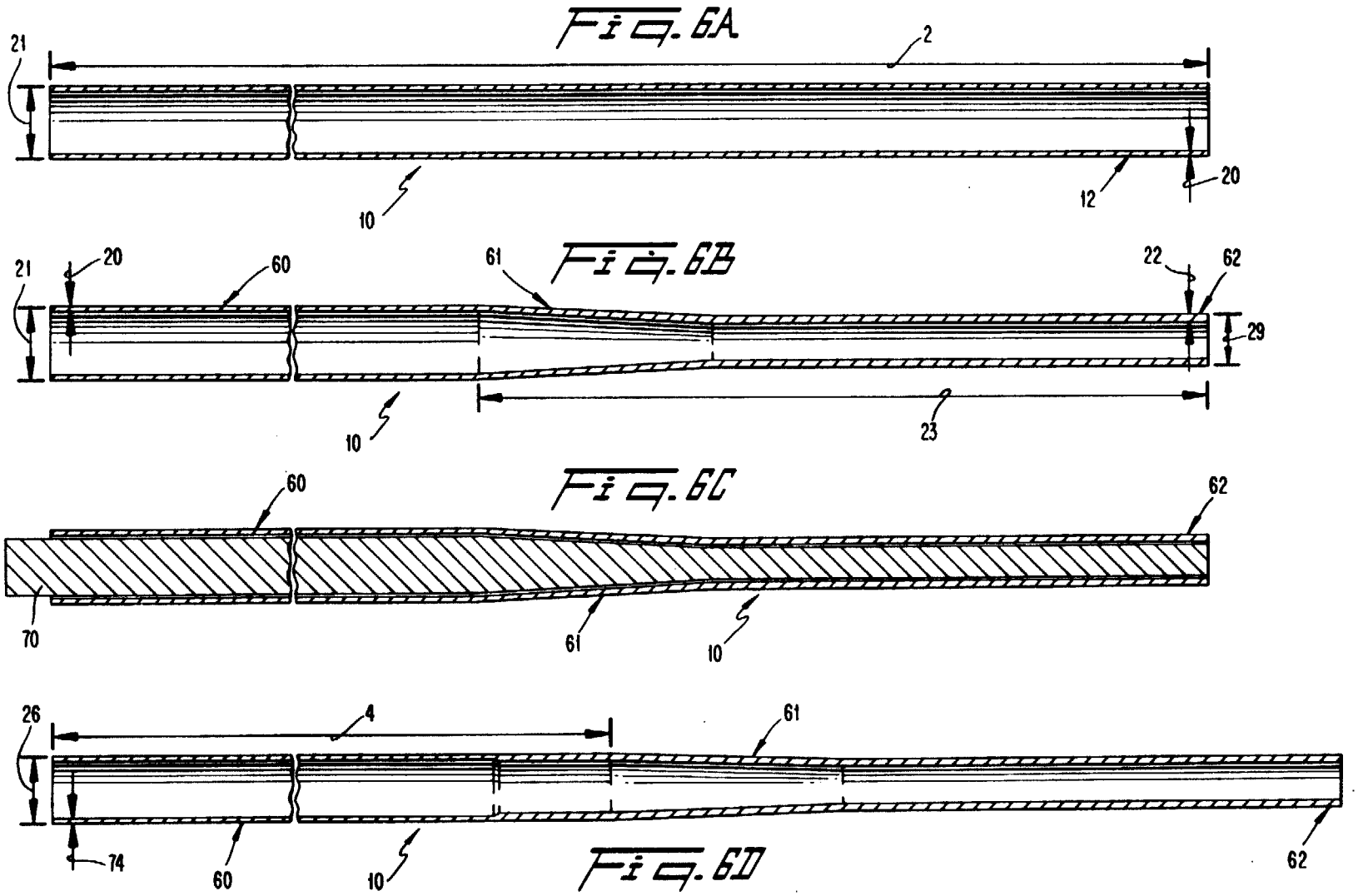
FIGS. 6A-6C show a second preferred embodiment of a shaft during various stages of fabrication.

With reference to FIG. 6B and FIG. 7, step A, it is shown that shaft 10 is subjected to the same rotary swaging operation of the first preferred embodiment shown in FIG. 2B and FIG. 1, step A and described previously. The swaging forms a rear portion 60, a front portion 62 and an interconnecting portion 61. The outer diameter 21 at one end 12 of shaft 10 is decreased to outer diameter 29 and the wall thickness 20 is increased to a thickness 22. The interconnecting portion 61 and the front portion 62 extend a length 23 at one end 12 of the shaft 10. In the second embodiment, the reduced outer diameter 29 is preferably about 0.450", the increased thickness 22 is preferably about 0.030" and length 23 is preferably about 6.25".

In the next step of the second preferred embodiment (see FIGS. 6C-6D and FIG. 7, step B), instead of performing a sink drawing operation as with the first embodiment, a mandrel drawing operation is performed. A hardened steel mandrel 70 is inserted into shaft 10 as shown in FIG. 6C and the drawing tool (not shown) is clamped to the front portion 64 of the shaft in a conventional manner. Conventional mandrel drawing is then performed on the rear portion 60 of the metal shaft adjacent the interconnecting portion 61.

Since mandrel 70 travels with the shaft 10 during mandrel drawing and, therefore, remains inside of shaft 10 after mandrel drawing, the mandrel must be removed to allow further forming operations. Consequently, included in the second step of the second preferred embodiment of FIG. 7, step B is an operation wherein shaft 10 with mandrel 70 within, is subjected to a "derodding" process which involves passing shaft 10 and mandrel 70 through a double roll to "reel" the shaft 60 from the mandrel 70. This process is well known in the art.

The mandrel drawing step includes at least one draw pass and, as shown in FIG. 6D, reduces the original outer diameter 21 of the shaft to a smaller outer diameter 26 while increasing the length of the rear portion 60 to an increased length 4. In addition, initial wall thickness 20 is decreased to a reduced thickness 74. In the second preferred embodiment, the smaller outer diameter 26 will be about 0.593", the increased length 4 will be about 33.75" and the reduced wall thickness 74 will be about 0.020". The smaller outer diameter 26 may be increased to the typically desired outer diameter of about 0.600 inches in a heat treatment process at the conclusion of all metal working.

After the derodding operation of step B (FIG. 7) is completed, the metal shaft is subjected to a rotary swaging operation in as shown in FIG. 7, step C. Step C of FIG. 7 is the same swaging operation of step C, FIG. 2 of the first preferred embodiment described previously and provides the same shaft as shown in FIG. 3, also discussed previously.

The method of the second embodiment of the present invention may be desired over the first embodiment if the dimensions of the metal tube stock that is intended for fabrication are nearer the preferred values of the second embodiment than those of the first embodiment.

The principles, preferred embodiment and mode of operation of the present invention have been described in the foregoing specification. However, the invention which is intended to be protected is not to be construed as limited to the particular embodiment disclosed. The embodiment is to be regarded as illustrative rather than restrictive. Variations and changes may be made by others without departing from the spirit of the present invention. Accordingly, it is expressly intended that all such variations and changes which fall within the spirit and scope of the present invention as defined in claims be embraced thereby.

What is claimed is:

1. A method of making a shaft for sporting implements which comprises the steps of:

providing a metal shaft having a first outer diameter and a first shaft wall thickness, rotary swaging an end of said metal shaft to form a shaft having a shaft front portion, a shaft rear portion and an interconnecting portion that interconnects said front and rear portions, said front portion having a second outer diameter smaller than said first outer diameter and a first front portion wall thickness larger than said first shaft wall thickness, drawing said rear portion of said metal shaft to a third outer diameter smaller than said first outer diameter and larger than said second outer diameter, rotary swaging a region including said front portion, said interconnecting portion and a segment adjacent said interconnecting portion such that said front end portion has a fourth outer diameter smaller than said second outer diameter and a second front portion wall thickness greater than said first front portion wall thickness and such that said interconnecting portion has a smooth taper that narrows from said third outer diameter to said fourth outer diameter.

2. A method of making a shaft for sporting implements according to claim 1, wherein said drawing step is a sink drawing step.

3. A method of making a shaft for sporting implements according to claim 1, wherein said drawing step is a mandrel drawing step such that said first shaft wall thickness is increased to a second shaft wall thickness, said second shaft wall thickness being smaller than said first front portion wall thickness.

4. A method of making a shaft for sporting implements according to claim 2, wherein said step of rotary swaging a region including said front portion, said interconnecting portion and a segment adjacent said interconnecting portion further provides said interconnecting portion with a wall thickness that smoothly increases along said taper from said first shaft wall thickness to a maximum interconnecting portion thickness, aid maximum interconnecting portion wall thickness being smaller than said second front portion wall thickness.

5. A method of making a shaft for sporting implements according to claim 3, wherein said step of rotary swaging a region including said front portion, said interconnecting portion and a segment adjacent said interconnecting portion further provides said interconnecting portion with a wall thickness that smoothly increases along said taper from said second shaft wall thickness to a maximum interconnecting portion thickness, said maximum interconnecting portion wall thickness being smaller than said second front portion wall thickness.

6. A method of making a shaft for sporting implements according to claim 3, wherein said mandrel drawing step includes derodding a mandrel from said metal shaft following a final draw pass.

7. A method of making a shaft for sporting implements according to claim 1, wherein said metal shaft is comprised of seamless titanium alloy tubing.

8. A method of making a shaft for a golf club which comprises the steps of:

providing a metal shaft having a first outer diameter and a first shaft wall thickness, rotary swaging an end of said metal shaft to form a shaft having a shaft front portion for receiving a club head, a shaft rear portion and an interconnecting portion that interconnects said front and rear portions, said front portion having a second outer diameter smaller than said first outer diameter and a first front portion wall thickness larger than said first shaft wall thickness, drawing said rear portion of said metal shaft to a third outer diameter smaller than said first outer diameter and larger than said second outer diameter, rotary swaging a region including said front portion, said interconnecting portion and a segment adjacent said interconnecting portion such that said front end portion is suited for receiving a club head and has a fourth outer diameter smaller than said second outer diameter and a second front portion wall thickness greater than said first front portion wall thickness and such that said interconnecting portion has a smooth taper that narrows from said third outer diameter to said fourth outer diameter.

9. A method of making a shaft for a golf club according to claim 8, wherein said drawing step is a sink drawing step.

10. A method of making a shaft for a golf club according to claim 8, wherein said drawing step is a mandrel drawing step such that said first shaft wall thickness is increased to a second shaft wall thickness, said second shaft wall thickness being smaller than said first front portion wall thickness.

11. A golf club which includes a hollow metal shaft, a means for gripping and a golf club head, said shaft comprising:

a rear portion for receiving said means for gripping having a first outer diameter and a substantially constant first wall thickness, a cylindrical front portion attached to said golf club head, said cylindrical front portion having a second outer diameter smaller than said first outer diameter and a second wall thickness larger than said first wall thickness and substantially constant over at least a portion of a length of said front portion, an interconnecting portion interconnecting said rear portion with said front portion, said interconnecting portion having a smoothly decreasing outer diameter front said rear portion to said front portion to form a taper, said interconnecting portion having a smoothly increasing wall thickness along said taper from said first wall thickness to a maximum interconnecting portion wall thickness, said maximum interconnecting portion wall thickness being smaller than said second wall thickness of said front portion.

12. A golf club according to claim 11, wherein said shaft comprises seamless titanium tubing.

* * * * *